US009109372B1

(12) United States Patent
Bohrk et al.

(10) Patent No.: US 9,109,372 B1
(45) Date of Patent: Aug. 18, 2015

(54) BOLT POSITIONING SYSTEM FOR AN ANCHOR BOLT

(71) Applicants: William L. Bohrk, Newport Beach, CA (US); John A. Robbins, Newport Beach, CA (US); James R. Zarian, Corona Del Mar, CA (US)

(72) Inventors: William L. Bohrk, Newport Beach, CA (US); John A. Robbins, Newport Beach, CA (US); James R. Zarian, Corona Del Mar, CA (US)

( * ) Notice: Subject to any disclaimer, the term of this patent is extended or adjusted under 35 U.S.C. 154(b) by 0 days.

(21) Appl. No.: 14/312,508

(22) Filed: Jun. 23, 2014

Related U.S. Application Data

(60) Provisional application No. 61/964,993, filed on Jan. 22, 2014, provisional application No. 61/959,236, filed on Aug. 19, 2013.

(51) Int. Cl.
*E04G 17/04* (2006.01)

(52) U.S. Cl.
CPC ..... *E04G 17/042* (2013.01)

(58) Field of Classification Search
CPC ..... E04G 17/04; E04G 17/042
USPC ..... 249/91
See application file for complete search history.

(56) References Cited

U.S. PATENT DOCUMENTS

| | | | | | |
|---|---|---|---|---|---|
| 1,526,776 | A * | 2/1925 | Dalidz | 249/15 |
| 3,077,653 | A * | 2/1963 | Ward | 249/196 |
| 3,263,956 | A * | 8/1966 | Hawkins | 249/40 |
| 3,899,155 | A * | 8/1975 | Ward | 249/189 |
| 4,145,024 | A * | 3/1979 | Ward | 249/35 |
| 4,202,494 | A * | 5/1980 | Rumell | 238/83 |
| 4,589,792 | A * | 5/1986 | Niziol | 403/11 |
| 4,618,464 | A * | 10/1986 | Ditcher | 264/35 |
| 4,637,585 | A * | 1/1987 | Picollo | 249/10 |
| 4,740,018 | A * | 4/1988 | Kenmochi | 285/125.1 |
| 4,740,124 | A * | 4/1988 | Pearson et al. | 411/88 |
| 4,865,500 | A * | 9/1989 | Duran et al. | 411/103 |
| 4,906,153 | A * | 3/1990 | Duran | 411/353 |
| 4,948,089 | A * | 8/1990 | Knodel et al. | 249/86 |
| 4,951,914 | A * | 8/1990 | Meyers et al. | 249/11 |
| 5,126,095 | A * | 6/1992 | Crosno et al. | 264/516 |
| 5,670,076 | A * | 9/1997 | Leek | 249/53 M |
| 5,813,188 | A * | 9/1998 | Behlen | 52/699 |
| 6,109,587 | A * | 8/2000 | Peacock et al. | 249/91 |
| 6,132,663 | A * | 10/2000 | Johnson et al. | 264/250 |
| 6,431,517 | B1 * | 8/2002 | Chapman | 249/93 |
| 6,832,456 | B1 * | 12/2004 | Bilowol | 52/426 |
| 7,331,148 | B2 * | 2/2008 | Di Lorenzo | 52/481.1 |
| 7,445,192 | B2 * | 11/2008 | Gridley et al. | 249/207 |
| 7,467,777 | B2 * | 12/2008 | Huber et al. | 249/214 |
| 8,448,397 | B2 * | 5/2013 | Tincher et al. | 52/293.3 |
| 8,911,191 | B2 * | 12/2014 | James | 411/172 |
| 2001/0004099 | A1 * | 6/2001 | Onishi | 248/49 |
| 2003/0155683 | A1 * | 8/2003 | Pietrobon | 264/130 |
| 2006/0216132 | A1 * | 9/2006 | Le | 411/353 |
| 2009/0146043 | A1 * | 6/2009 | Gates | 249/103 |
| 2010/0101175 | A1 * | 4/2010 | Hohmann | 52/698 |

* cited by examiner

*Primary Examiner* — Yogendra Gupta
*Assistant Examiner* — Emmanuel S Luk

(57) ABSTRACT

A bolt positioning system for securely positioning an anchor bolt prior to pouring concrete features a linear form. The system features a bolt having a first bolt end with threads. The system features a bracket having a base bracket component, a positioning bracket component, and a riser bracket component located between the base bracket component and the positioning bracket component. An end tab component is perpendicularly located on the base bracket component opposed to the positioning bracket component. A fastening aperture is located on the base bracket component. A rectangular positioning aperture is located on the positioning bracket component. The system features an insert located in the positioning aperture.

18 Claims, 7 Drawing Sheets

BOLT POSITIONING SYSTEM FOR AN ANCHOR BOLT

CROSS REFERENCE

This application claims priority to U.S. Provisional Patent Application No. 61/959,236, filed Aug. 19, 2013, and to U.S. Provisional Patent Application No. 61/964,993, filed Jan. 22, 2014, the specification(s) of which are incorporated herein in their entirety by reference.

FIELD OF THE INVENTION

The present invention relates to bolt positioning and retaining devices and systems for embedding a bolt in concrete.

BACKGROUND OF THE INVENTION

When pouring a concrete slab or footing, it is often necessary to embed a bolt or a stud into the concrete. Once the concrete dries, the bolt or stud projects outwardly from the concrete slab or footing. It is important to firmly position the bolt or stud while the concrete is setting up, or else the bolt or stud could be permanently embedded at an undesired height, angle, or position. The present invention features a bolt positioning system for securely positioning an anchor bolt prior to pouring concrete.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a bolt positioning system for securely positioning an anchor bolt prior to pouring concrete. In some embodiments, the system comprises a linear form. In some embodiments, the system comprises a bolt having a first bolt end comprising threads.

In some embodiments, the system comprises a bracket having a base bracket component, a positioning bracket component, and a riser bracket component located between the base bracket component and the positioning bracket component. In some embodiments, an end tab component is perpendicularly located on the base bracket component opposed to the positioning bracket component.

In some embodiments, a fastening aperture is located on the base bracket component. In some embodiments, a rectangular positioning aperture is located on the positioning bracket component. In some embodiments, the system comprises an insert. In some embodiments, the insert is located in the positioning aperture.

DESCRIPTION OF PREFERRED EMBODIMENTS

Figure 1:
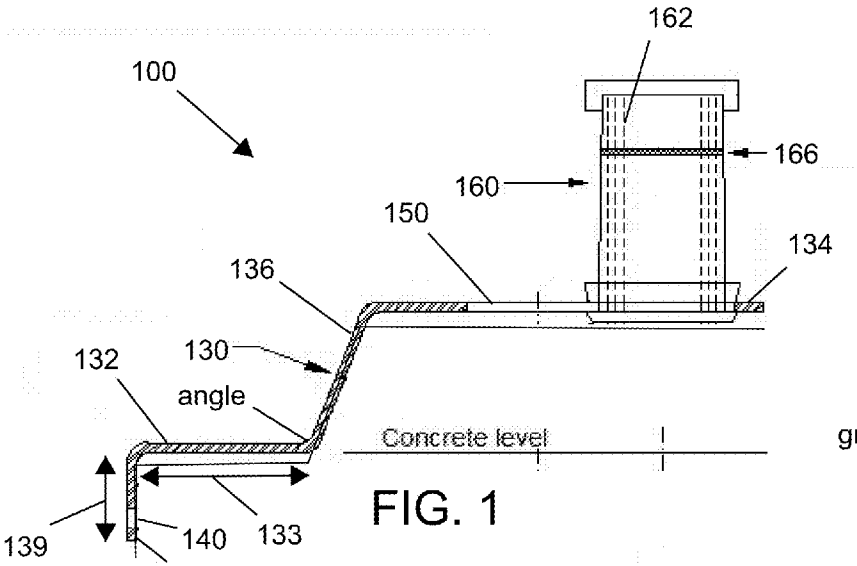
FIG. 1 shows a cross-sectional view of the bracket and the insert of the present invention.
Figure 2:
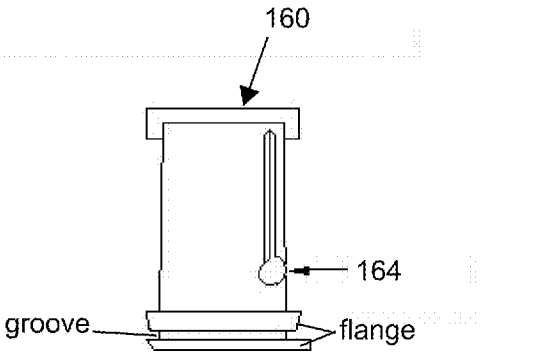
FIG. 2 shows a side view of the insert of the present invention.
Figure 3:
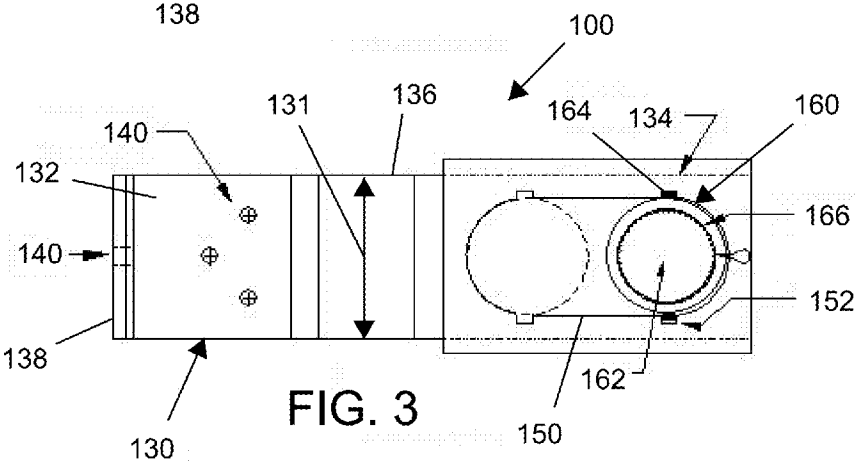
FIG. 3 shows a top view of the bracket and the insert of the present invention.
Figure 4:
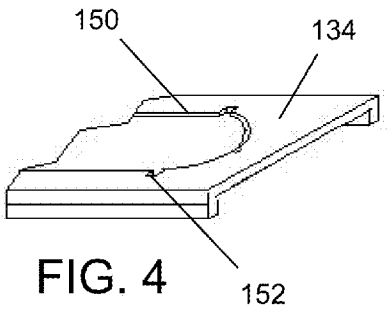
FIG. 4 shows a perspective view of the positioning bracket component of the present invention.
Figure 5:
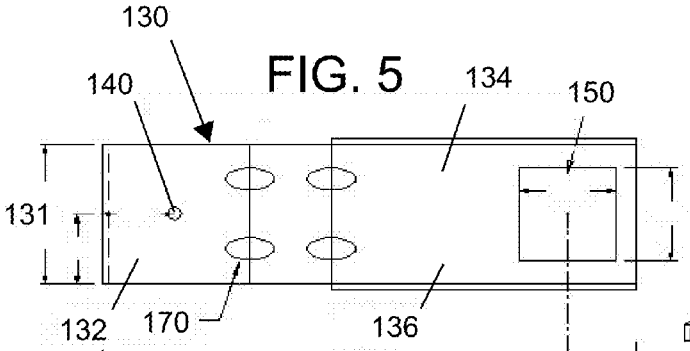
FIG. 5 shows a top view of an alternate embodiment of the bracket of the present invention.
Figure 6:
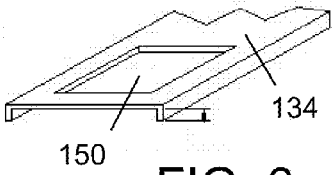
FIG. 6 shows a perspective view of an alternate embodiment of the positioning bracket component of the present invention.
Figure 7:
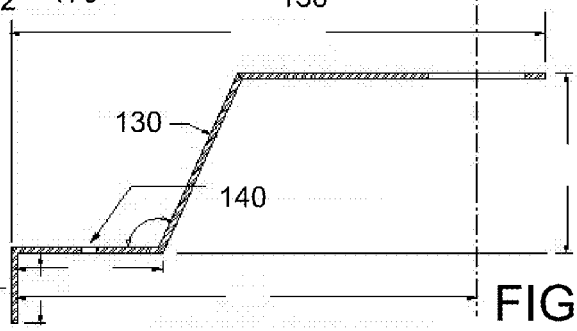
FIG. 7 shows a cross-sectional view of an alternate embodiment of the bracket of the present invention.
Figure 8:
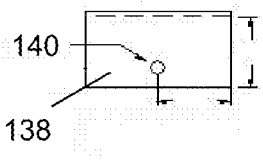
FIG. 8 shows a front view of the end tab component of the present invention.
Figure 9:
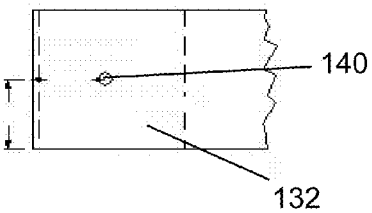
FIG. 9 shows a top view of the base bracket component of the present invention.
Figure 10:
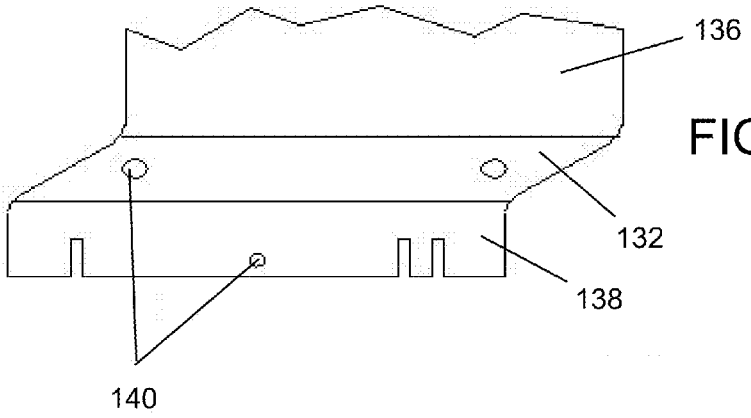
FIG. 10 shows a perspective view of an alternate embodiment of the base bracket component and the end tab component of the present invention.
Figure 11:
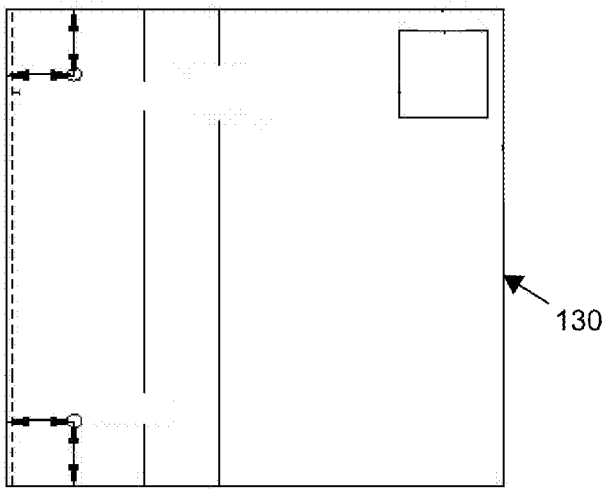
FIG. 11 shows a top view of an alternate embodiment of the bracket of the present invention.
Figure 12:
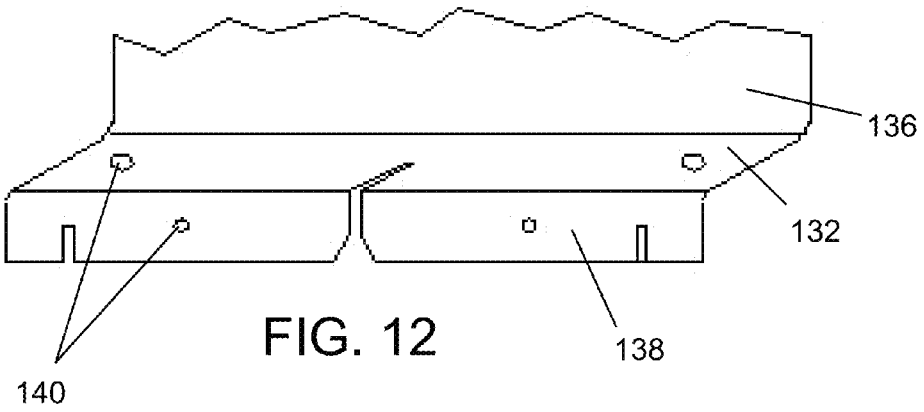
FIG. 12 shows a perspective view of an alternate embodiment of the base bracket component and the end tab component of the present invention.
Figure 13:
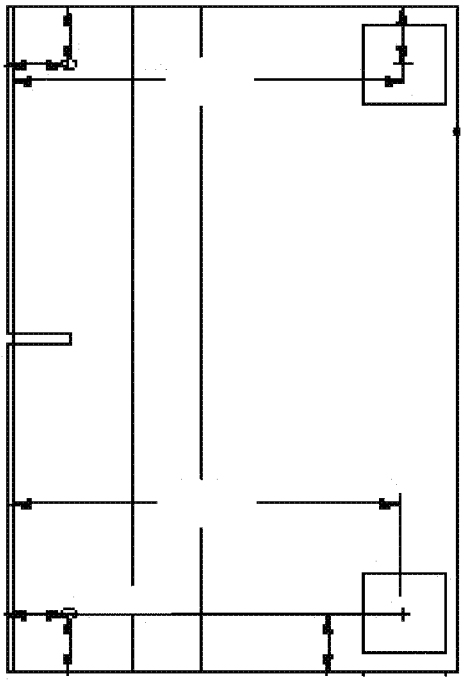
FIG. 13 shows a top view of an alternate embodiment of the bracket of the present invention.
Figure 14:
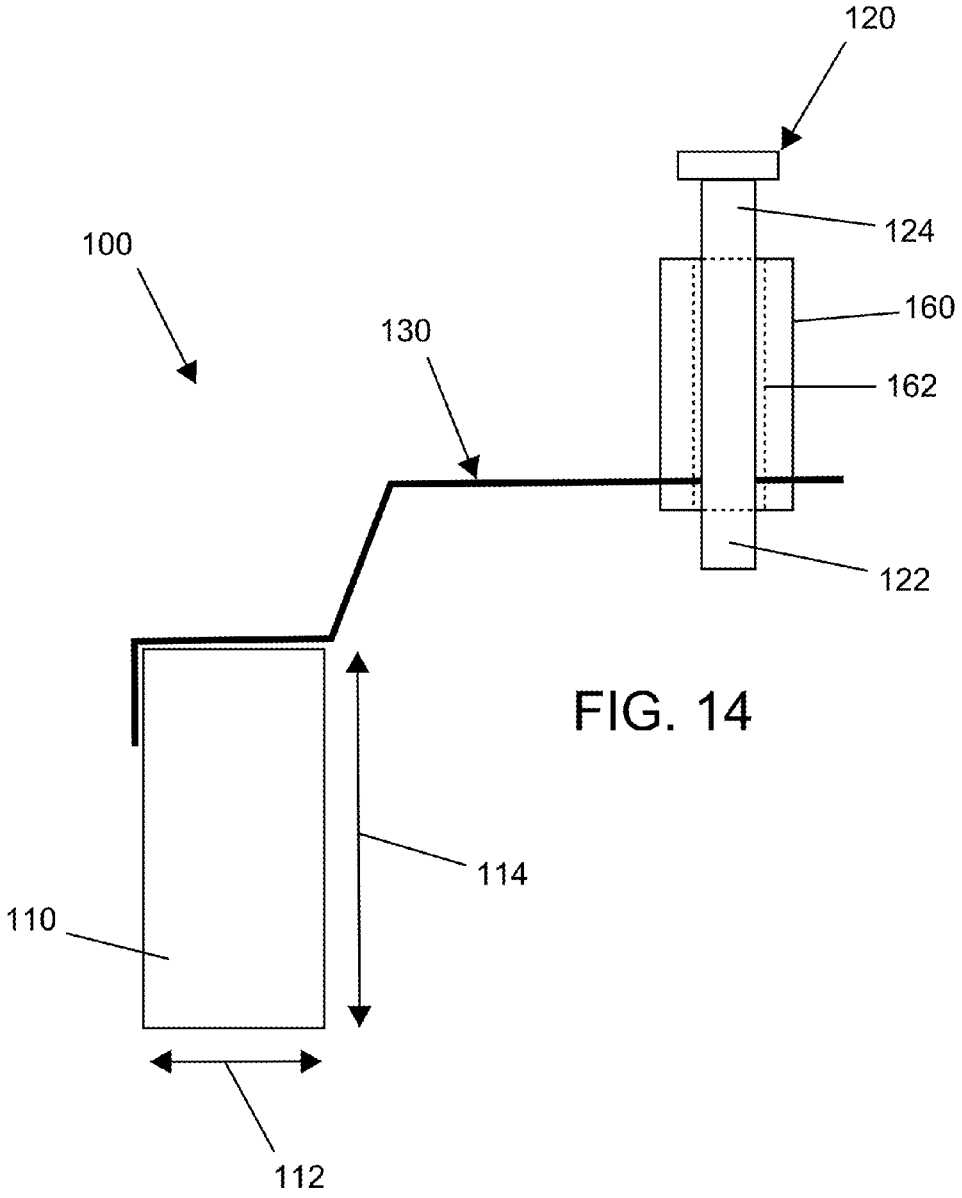
FIG. 14 shows a side view of the present invention.
Figure 15:
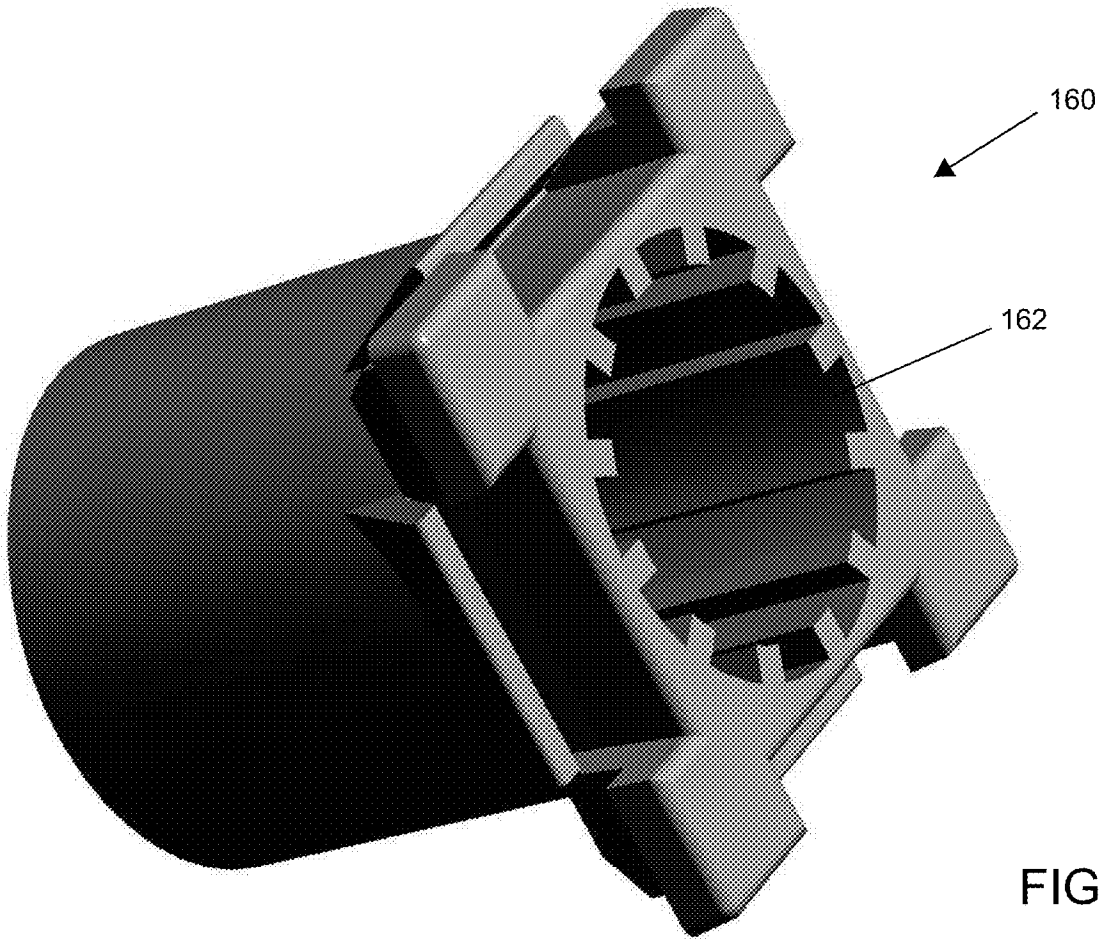
FIG. 15 shows a perspective view of the insert of the present invention.
Figure 16:
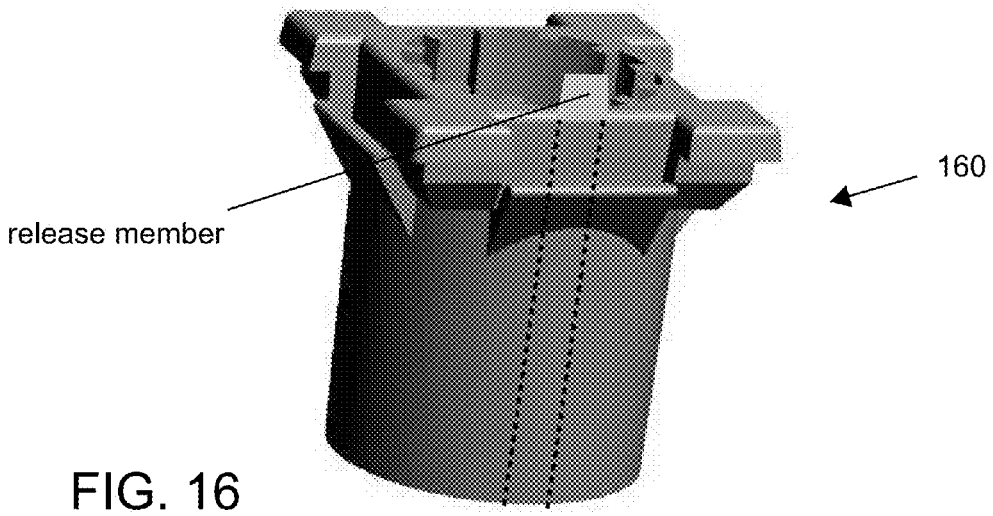
FIG. 16 shows a side view of the insert of the present invention.
Figure 17:
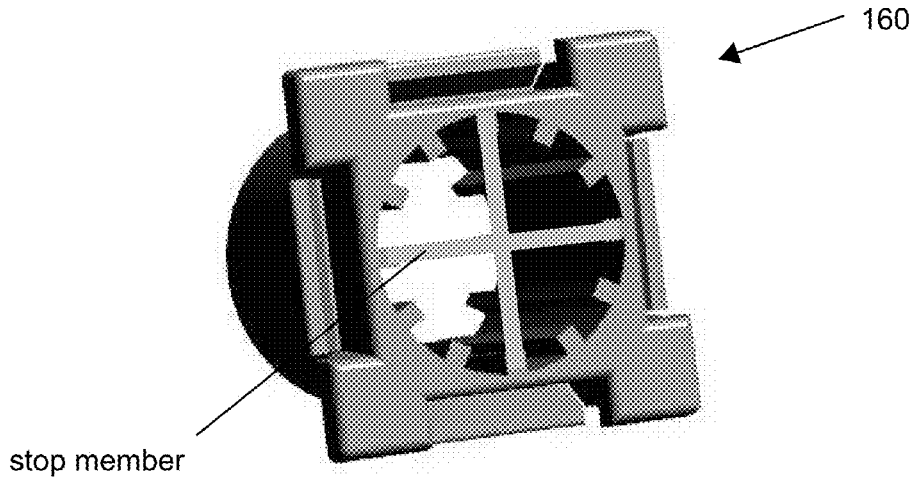
FIG. 17 shows a perspective view of the insert of the present invention.

Following is a list of elements corresponding to a particular element referred to herein:

100 Bolt positioning system
110 Form
112 Form width
114 Form height
120 Bolt
122 First bolt end
124 Second bolt end
130 Bracket
131 Bracket width
132 Base bracket component
133 Base bracket component length
134 Positioning bracket component
136 Riser bracket component
138 End tab component
139 End tab component length
140 Fastening aperture
150 Positioning aperture
152 Notch
160 Insert
162 Cylindrical channel
164 Nub
166 Teeth
170 Support rib Referring now to FIG. 1-17, the present invention features a bolt positioning system (100) for securely positioning an anchor bolt prior to pouring concrete. In some embodiments, the system (100) comprises a metal bracket (130) configured to accept a separate plastic insert (160). In some embodiments, the metal bracket (130) is designed such that it securely positions an anchor bolt (120) in a horizontal plane at a desired distance from a form (110). In some embodiments, the plastic insert (160) is designed such that it securely positions the anchor bolt (120) in a vertical plane. In some embodiments, a nut is installed on threads of the anchor bolt (120) to hold the anchor bolt (120) from sliding downward.

In some embodiments, the present invention features a bolt positioning system (100) for securely positioning an anchor bolt prior to pouring concrete. In some embodiments, the system (100) comprises a linear form (110). In some embodiments, the form (110) comprises a form width (112) of 1.5 inches and a form height (114). In some embodiments, the form (110) is constructed from 2×4 lumber and retains the width and height thereof. In some embodiments, the form (110) is constructed from 2×6 lumber and retains the width and height thereof. In some embodiments, the form (110) is constructed from 2×8 (or wider) lumber and retains the width and height thereof. In some embodiments, the form (110) is constructed from lumber and retains the width and height thereof.

In some embodiments, the system (100) comprises a bolt (120) having a first bolt end (122) comprising threads and a second bolt end (124). In some embodiments, the bolt (120) comprises a head located on a second bolt end (124) thereon. In some embodiments, the bolt (120) comprises an "L" or a "J" shape located on a second bolt end (124) thereon.

In some embodiments, the system (100) comprises a bracket (130) having a base bracket component (132), a positioning bracket component (134), and a riser bracket component (136) located between the base bracket component (132) and the positioning bracket component (134). In some embodiments, an end tab component (138) is perpendicularly located on the base bracket component (132) opposed to the positioning bracket component (134).

In some embodiments, the system (100) comprises a bracket (130) having a base bracket component (132) having a base bracket anterior edge, a base bracket posterior edge, a base bracket first side edge, and a base bracket second side edge. In some embodiments, the system (100) comprises a bracket (130) having a positioning bracket component (134) having a positioning bracket anterior edge, a positioning bracket posterior edge, a positioning bracket first side edge, and a positioning bracket second side edge. In some embodiments, the system (100) comprises a bracket (130) having a riser bracket component (136) having a riser bracket anterior edge, a riser bracket posterior edge, a riser bracket first side edge, and a riser bracket second side edge. In some embodiments, the riser bracket component (136) is located between the base bracket component (132) and the positioning bracket component (134). In some embodiments, the base bracket anterior edge is angularly located on the riser bracket posterior edge. In some embodiments, the riser bracket anterior edge is angularly located on the positioning bracket posterior edge. In some embodiments, an end tab component (138) is perpendicularly located on the base bracket posterior edge.

In some embodiments, the riser bracket component (136) angularly projects out and away from the base bracket component (132). In some embodiments, the end tab component (138) perpendicularly projects out and away from the base bracket component (132) in a direction generally opposed to the direction of the riser bracket component (136), In some embodiments, the base bracket component (132) projects out and away from the riser bracket component (136). In some embodiments, the positioning bracket component (134) projects out and away from the riser bracket component (136) in a direction opposed to the direction of the base bracket component (132).

In some embodiments, the base bracket component (132) comprises a base bracket component (132) length of 1.5 inches which is equal to a width of a 2×4 piece of lumber. In some embodiments, base bracket component (132) length of 1.5 inches is CRITICAL to the novelty and function of the present invention as it enables the bracket (130) to be quickly positioned in a single horizontal position in an exact manner on the form (110) and held in place by a single fastener. In some embodiments, the end tab component (138) comprises an end tab component length (139) of 0.75 inches, or one half of the base bracket component length (133). In some embodiments, the end tab component (138) comprises an end tab component length (139) between 0.50 inches and 1 inch.

In some embodiments, the riser bracket component (136) is located on the base bracket component (132) at an angle between 100 degrees and 120 degrees and the positioning bracket (130) is located on the riser bracket component (136) at an angle between 100 degrees and 120 degrees. In some embodiments, the riser bracket component (136) is located on the base bracket component (132) at an angle between 120 degrees and 160 degrees and the positioning bracket (130) is located on the riser bracket component (136) at an angle between 120 degrees and 160 degrees. In some embodiments, the riser bracket component (136) is located on the base bracket component (132) at an angle between 90 degrees and 180 degrees and the positioning bracket (130) is located on the riser bracket component (136) at an angle between 90 degrees and 180 degrees.

In some embodiments, a fastening aperture (140) is located on the base bracket component (132) at an offset 0.75 inches from an intersection of the base bracket component (132) and the riser bracket component (136). In some embodiments, the fastening aperture (140) is located on the base bracket component (132) at the offset 0.75 inches from an intersection of the base bracket component (132) and the end tab component (138). In some embodiments the fastening aperture (140) is located at a midpoint between the intersection of the intersection of the base bracket component (132) and the riser bracket component (136) and the intersection of the base bracket component (132) and the end tab component (138).

In some embodiments, a rectangular positioning aperture (150) is located on the positioning bracket component (134). In some embodiments, a positioning aperture (150) is located on the positioning bracket component (134). In some embodiments, a plurality of positioning apertures (150) is located on the positioning bracket component (134). In some embodiments, the positioning aperture (150) may be elliptical, oval, round, square, or rectangular.

In some embodiments, the system (100) comprises an insert (160). In some embodiments, the insert (160) is located in and designed to snuggly, yet slidably fit into the positioning aperture (150). In some embodiments, the insert (160) snaps into place into the positioning aperture (150). In some embodiments, the insert (160) comprises a cylindrical channel (162) for insertion of the bolt (120) for positioning.

In some embodiments, channels are located on an inner periphery of the cylindrical channel (162) running in line with the cylindrical channel (162).

In some embodiments, one or more linear form pieces (110) are positioned together in a manner to provide a form (110) for shaping concrete. In some embodiments, the bracket (130) is secured to the form (110). In some embodiments, a bottom surface of the base bracket component (132) is secured to a form top edge. In some embodiments, an inside surface of the end tab component (138) is located interfacingly against a form outside surface. In some embodiments, a single fastener is inserted through the fastening aperture (140) on the base bracket component (132) into the form (110) to securely hold the bracket (130) in place. In some embodiments, the ability to use a single fastener through the fastening aperture (140) on the base bracket component (132) into the form (110) to securely hold the bracket (130) in place is CRITICAL to this invention.

In some embodiments, the bolt (120) is placed through the insert (160) located in the positioning aperture (150) for securely holding the bolt (120) into position while protecting the threads on the bolt (120) via the bolt positioning system (100) prior to pouring concrete around the bolt (120).

In some embodiments, the form height (114) or board width is 3.5 inches. In some embodiments, the form (110) is constructed from a wooden 2×4. In some embodiments, the form height (114) or board width is 5.5 inches. In some embodiments, the form (110) is constructed from a wooden 2×6. In some embodiments, the form height (114) or board width is 7.25 inches. In some embodiments, the form (110) is constructed from a wooden 2×8. In some embodiments, the form height (114) or board width is 9.25 inches. In some embodiments, the form (110) is constructed from a wooden 2×10. In some embodiments, the form height (114) or board width is 11.25 inches. In some embodiments, the form (110) is constructed from a wooden 2×12.

In some embodiments, the bracket (130) comprises a bracket width (131) of 1.5 inches. In some embodiments, the bracket (130) comprises a bracket width (131) of 5.5 inches. In some embodiments, the bracket (130) comprises a bracket width (131) of 8.5 inches. In some embodiments, the bracket (130) comprises a bracket width (131) between 1 inch and 12 inches. In some embodiments, the insert (160) is located in the positioning aperture (150) and is rigidly affixed into position. In some embodiments, the insert (160) is located in the positioning aperture (150) and is adjustably slidable in a horizontal plane. In some embodiments, a plurality of inserts (160) is attachably inserted into the positioning aperture (150) simultaneously.

In some embodiments, the insert (160) comprises a cylindrical channel (162) for insertion of the bolt (120) for positioning. In some embodiments, the insert (160) comprises a first cylindrical channel (162) and a second cylindrical channel (162) for insertion of the bolt (120) for positioning. In some embodiments, the insert (160) comprises a plurality of cylindrical channels (162) for insertion of the bolt (120) for positioning.

In some embodiments, the positioning aperture (150) comprises a notch (152) located therein for interfacing with the insert (160). In some embodiments, the insert (160) comprises a projecting nub (164) located on an exterior sidewall thereon. In some embodiments, the insert (160) is placed into the positioning aperture (150) in a predetermined position via the projecting nub (164) and the notch (152).

In some embodiments, one or more support ribs (170) are perpendicularly located at the intersection where the riser bracket component (136) is located on the base bracket component (132) for rigidity.

In some embodiments, one or more support ribs (170) are perpendicularly located at the intersection where the positioning bracket component (134) is located on the riser bracket component (136) for rigidity.

In some embodiments, the insert (160) comprises inwardly facing teeth (166) located around an inner periphery of a cylindrical sidewall thereon for securely holding and positioning the bolt (120). In some embodiments, the inwardly facing teeth (166) are located around an inner periphery of a cylindrical sidewall for interfacingly contacting the bolt. In some embodiments, the inwardly facing teeth (166) allow the bolt (120) to be inserted and removed from either direction. In some embodiments, with the use of the inwardly facing teeth, no nut is required for securing the bolt (120).

In some embodiments, the insert (160) is interchangeable. In some embodiments, the interchangeable insert (160) comprises a cylindrical channel (162) having a diameter sized to receive the bolt having a bolt diameter selected from a group consisting of the following: ½ inch, ⅝ inch, ¾inch, ⅞ inch, smaller than ½ inch, larger than 1 inch, and any other standard SAE or Metric sizes.

In some embodiments, the interchangeable insert (160) is color-coded with respect to the diameter size. In some embodiments the insert (160) is constructed from nylon, polypropylene, polyethylene, plastic, a polymer or copolymer. In some embodiments, the bracket (130) is metal. In some embodiments, it is critical that the insert (160) is formed from nylon, polypropylene, polyethylene, plastic, a polymer or copolymer and that bracket (130) is constructed from a metal.

In some embodiments, the interchangeable insert (160) is adapted to receive the bolt (120) inserted therethrough from either end thus providing an alternate position for the bolt (120). In some embodiments, this feature allows the system (100) to be positioned with the bracket (130) upside down. In some embodiments, the interchangeable insert (160) comprises a stop member located on an insert end. In some embodiments, the stop member is adapted to provide a physical barrier for positioning the bolt (120). In some embodiments, the interchangeable insert (160) comprises a release member located on a sidewall thereon. In some embodiments, upon activation of the release member, a portion of the sidewall is permanently removed from the insert (160) for easy removal of the insert (160).

In some embodiments, the present invention (100) is constructed from plastic (insert (160)) and metal (bracket (130)). In some embodiments, the use of plastic is economically advantageous for the construction of the insert (160) as the insert (160) can be disposable and reusable, while the more durable stronger bracket (130) constructed from metal can be reused many times. In some embodiments, the use of plastic is advantageous for the construction of the insert (160) as the insert (160) can be made to accommodate a variety of sizes of bolts (120). In some embodiments, the use of plastic is advantageous for the construction of the insert (160) as the insert (160) can be made to accommodate a variety of positional offsets from the form (110) for bolt (120) placement, for example the insert (160) comprises a plurality of inserts (160) or a single insert (160) having a series of cylindrical channels linearly attached to one another in a series on a cylindrical channel external side wall.

In some embodiments, the use of metal is advantageous for the construction of the bracket (130) as the bracket (130) is reusable. Further metal can withstand the environmental factors associated with concrete foundation construction far better than plastic which tends to fatigue after a few uses.

In some embodiments, the bolt (120) height is set correctly at 3 inches via the bracket (130) and the insert (160). In some embodiments, the bolt (120) height is set correctly at 1 inch or less via the bracket (130) and the insert (160). In some embodiments, the bolt (120) height is set correctly at 2 inches via the bracket (130) and the insert (160). In some embodiments, the bolt (120) height is set correctly at 4 inches via the bracket (130) and the insert (160). In some embodiments, the bolt (120) height is set correctly at 5 inches or higher via the bracket (130) and the insert (160).

In some embodiments, the threads on the bolt (120) are protected from cement via the insert (160) and/or a nut over the threads of the bolt (120).

In some embodiments, the present invention features one nail installation.

In some embodiments, the bracket (130) features strengthening ribs (170) and a strengthening edge disposed on the positioning bracket component (134). In some embodiments, the strengthening edge is disposed on a first edge and a second edge of the positioning bracket component (134).

In some embodiments, the system is designed for use in a center wall application (tab set at 0.75"). In some embodiments, the bracket (130) can be placed upside down and accommodate the installation of the anchor bolt (120) at the proper height and horizontal position for a center wall foundation.

In some embodiments, the bracket (130) comprises a corrosion resistant coating. In some embodiments, the bracket (130) comprises a coating that resists concrete from adhering to its surface. In some embodiments, the bracket (130) comprises a coating that resists wet concrete from adhering to its surface. In some embodiments, the bracket (130) comprises a coating that resists dry concrete from adhering to its surface.

In some embodiments, the plastic insert (160) is made of a material that resists concrete from adhering to it.

In some embodiments, the bracket (130) is designed to position the anchor bolt height sufficiently so that the nut is secured in place and the plastic insert (160) protects the anchor bolt threads from being exposed to wet concrete. In some embodiments, that when the bracket (130) and plastic insert (160) are removed, a mudsill can be installed and the clean threads will allow easy installation of the washer and nut without having to clean them from concrete.

In some embodiments, the bracket (130) is designed to position the anchor bolt height sufficiently to allow any person skilled in the art enough room to trowel under the plastic insert (160) and around the anchor bolt (120).

In some embodiments, the concrete is designed to be a foundation whereby the anchor bolts secure the building structure to the foundation.

In some embodiments, by using a metal bracket (130), it can be used repeatedly while maintaining its strength. Commonly used plastic brackets become weakened after a few uses. Manufacturing practices and equipment pertaining to metal brackets (130) can be easily altered to accommodate revisions. Manufacturing practices and equipment pertaining to plastic brackets require new injection molds to incorporate these changes which takes a lot of time, money, and mold design work to accommodate revisions in the product. The metal bracket tooling is simple and easily changed.

Using a plastic insert (160) that fits a standard bolt diameter of a given bolt size allows the plastic insert (160) to be placed in different locations as required without having to make another injection mold. The plastic insert (160) is designed to be used once and thrown away. This allows for a less costly product because the metal bracket can be reused, only having to replace the small inexpensive plastic insert (160). This creates a very good economic advantage over any other product in the market.

In some embodiments, the present invention features versatility for different industries needing different bolt height and distance applications.

As used herein, the term "about" refers to plus or minus 10% of the referenced number.

The disclosures of the following U.S. patents are incorporated in their entirety by reference herein: U.S. Pat. No. 4,641,478; U.S. Pat. No. 5,688,428; U.S. Pat. No. 6,065,730; and U.S. Pat. No. 8,029,545.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bolt positioning system (100) for securely positioning an anchor bolt prior to pouring concrete, wherein the system (100) comprises:

(a) a linear form (110), wherein the form (110) comprises a form width (112) and a form height (114);

(b) a bolt (120) having a first bolt end (122) comprising threads and a second bolt end (124);

(c) a bracket (130) having a base bracket component (132) having a base bracket anterior edge, a base bracket posterior edge, a base bracket first side edge, and a base bracket second side edge, a positioning bracket component (134) having a positioning bracket anterior edge, a positioning bracket posterior edge, a positioning bracket first side edge, and a positioning bracket second side edge, and a riser bracket component (136) having a riser bracket anterior edge, a riser bracket posterior edge, a riser bracket first side edge, and a riser bracket second side edge, wherein the riser bracket component (136) is disposed between the base bracket component (132) and the positioning bracket component (134), wherein the base bracket anterior edge is angularly disposed on the riser bracket posterior edge, wherein the riser bracket anterior edge is angularly disposed on the positioning bracket posterior edge, wherein an end tab component (138) is perpendicularly disposed on the base bracket posterior edge, wherein the riser bracket component (136) angularly projects out and away from the base bracket component (132), wherein the end tab component (138) perpendicularly projects out and away from the base bracket component (132), wherein the base bracket component (132) projects out and away from the riser bracket component (136) and the positioning bracket component (134) each projects out and away from the riser bracket component (136) in a direction opposed to one another, wherein the base bracket component (132) comprises a base bracket component (132), wherein the end tab component (138) comprises an end tab component length (139), wherein a fastening aperture (140) is disposed on the base bracket component (132) at an offset from an intersection of the base bracket component (132) and the riser bracket component (136), wherein the fastening aperture (140) is disposed on the base bracket component (132) at the offset from an intersection of the base bracket component (132) and the end tab component (138), wherein a positioning aperture (150) is disposed on the positioning bracket component (134); and (d) an insert (160), wherein the insert (160) is attachably disposed in the positioning aperture (150), wherein the insert (160) comprises a cylindrical channel (162) for insertion of the bolt (120) for positioning;

wherein one or more linear forms (110) are disposed in a manner to provide a form (110) for shaping concrete, wherein the bracket (130) is disposed on the form (110), wherein the base bracket component (132) is disposed on a form top edge, wherein the end tab component (138) is disposed interfacingly against a form outside surface, wherein only a single fastener is disposed through the fastening aperture (140) into the form (110) to securely hold the bracket (130) in place, wherein the bolt (120) is disposed through the cylindrical channel (162) of the insert (160) disposed in the positioning aperture (150) for securely holding the bolt (120) into position while protecting threads on the bolt via the bolt positioning system (100) prior to pouring concrete around the bolt (120).

2. The system (100) of claim 1, wherein the form height (114) is 5.5 inches, wherein the form (110) is constructed from a wooden 2×6.

3. The system (100) of claim 1, wherein the form height (114) is 7.25 inches, wherein the form (110) is constructed from a wooden 2×8.

4. The system (100) of claim 1, wherein the form height (114) is 9.25 inches, wherein the form (110) is constructed from a wooden 2×10.

5. The system (100) of claim 1, wherein the form height (114) is 11.25 inches, wherein the form (110) is constructed from a wooden 2×12.

6. The system (100) of claim 1, wherein the bracket (130) comprises a bracket width (131) of 1.5 inches.

7. The system (100) of claim 1, wherein a plurality of inserts (160) is attachably disposed in the positioning aperture (150).

8. The system (100) of claim 1, wherein the insert (160) comprises at least a second cylindrical channel (162) for insertion of the bolt (120) for positioning, wherein the insert (160) comprises a plurality of cylindrical channels (162) for insertion of the bolt (120) for positioning.

9. The system (100) of claim 1, wherein the positioning aperture (150) comprises a notch (152) disposed therein for interfacing with the insert (160), wherein the insert (160) comprises a projecting nub (164) disposed on a sidewall thereon, wherein the insert (160) is disposed in the positioning aperture (150) in a predetermined position via the projecting nub (164) interacting with the notch (152).

10. The system (100) of claim 1, wherein one or more support ribs (170) are perpendicularly disposed at the intersection where the riser bracket component (136) is disposed on the base bracket component (132).

11. The system (100) of claim 1, wherein one or more support ribs (170) are perpendicularly disposed at the intersection where the positioning bracket component (134) is disposed on the riser bracket component (136).

12. The system (100) of claim 1, wherein the insert (160) comprises inwardly facing teeth (166) disposed around an inner periphery of a cylindrical sidewall thereon for interfacingly contacting the bolt therewith.

13. The system (100) of claim 1, wherein the insert (160) is interchangeable, wherein the interchangeable insert (160) comprises a cylindrical channel (162) having a diameter sized to receive the bolt.

14. The system of claim 13, wherein the interchangeable insert (160) is color-coded with respect to the diameter size.

15. The system of claim 13, wherein the interchangeable insert (160) is adapted to receive the bolt (120) inserted therethrough from either end thus providing an alternate position for the bolt (120).

16. The system of claim 13, wherein the interchangeable insert (160) comprises a stop member disposed on an insert end, wherein the stop member is adapted to provide a physical barrier for positioning the bolt (120).

17. The system of claim 13, wherein the interchangeable insert (160) comprises a release member disposed on a sidewall thereon, wherein upon activation of the release member, a portion of the sidewall is permanently removed from the insert (160) for easy removal of the insert (160).

18. A bolt positioning system (100) for securely positioning an anchor bolt prior to pouring concrete, wherein the system (100) comprises:

(a) a linear form (110), wherein the form (110) comprises a form width (112) of 1.5 inches and a form height (114);

(b) a bolt (120) having a first bolt end (122) comprising threads and a second bolt end (124);

(c) a bracket (130) having a base bracket component (132) having a base bracket anterior edge, a base bracket posterior edge, a base bracket first side edge, and a base bracket second side edge, a positioning bracket component (134) having a positioning bracket anterior edge, a positioning bracket posterior edge, a positioning bracket first side edge, and a positioning bracket second side edge, and a riser bracket component (136) having a riser bracket anterior edge, a riser bracket posterior edge, a riser bracket first side edge, and a riser bracket second side edge, wherein the riser bracket component (136) is disposed between the base bracket component (132) and the positioning bracket component (134), wherein the base bracket anterior edge is angularly disposed on the riser bracket posterior edge, wherein the riser bracket anterior edge is angularly disposed on the positioning bracket posterior edge, wherein an end tab component (138) is perpendicularly disposed on the base bracket posterior edge, wherein the riser bracket component (136) angularly projects out and away from the base bracket component (132), wherein the end tab component (138) perpendicularly projects out and away from the base bracket component (132), wherein the base bracket component (132) projects out and away from the riser bracket component (136) and the positioning bracket component (134) each projects out and away from the riser bracket component (136) in a direction opposed to one another, wherein the base bracket component (132) comprises a base bracket component (132) length of 1.5 inches, wherein the end tab component (138) comprises an end tab component length (139) of one half of the base bracket component length (133), wherein a fastening aperture (140) is disposed on the base bracket component (132) at an offset 0.75 inches from an intersection of the base bracket component (132) and the riser bracket component (136), wherein the fastening aperture (140) is disposed on the base bracket component (132) at the offset 0.75 inches from an intersection of the base bracket component (132) and the end tab component (138), wherein a positioning aperture (150) is disposed on the positioning bracket component (134); and (d) an insert (160), wherein the insert (160) is attachably disposed in the positioning aperture (150), wherein the insert (160) comprises a cylindrical channel (162) for insertion of the bolt (120) for positioning;

wherein one or more linear forms (110) are disposed in a manner to provide a form (110) for shaping concrete, wherein the bracket (130)*is* disposed on the form (110), wherein the base bracket component (132) is disposed on a form top edge, wherein the end tab component (138) is disposed interfacingly against a form outside surface, wherein only a single fastener is disposed through the fastening aperture (140) into the form (110) to securely hold the bracket (130) in place, wherein the bolt (120) is disposed through the cylindrical channel (162) of the insert (160) disposed in the positioning aperture (150) for securely holding the bolt (120) into position while protecting threads on the bolt via the bolt positioning system (100) prior to pouring concrete around the bolt (120).

* * * * *